US006749922B1

(12) United States Patent
Waselewski

(10) Patent No.: US 6,749,922 B1
(45) Date of Patent: Jun. 15, 2004

(54) FURNITURE PROTECTION SYSTEM

(75) Inventor: Ronald W. Waselewski, Clearwater, FL (US)

(73) Assignee: Blanca A. Sanchez, Clearwater, FL (US)

( * ) Notice: Subject to any disclaimer, the term of this patent is extended or adjusted under 35 U.S.C. 154(b) by 38 days.

(21) Appl. No.: 10/194,388

(22) Filed: Jul. 12, 2002

(51) Int. Cl.[7] ..... B32B 3/26

(52) U.S. Cl. ..... 428/121; 428/121; 150/158; 297/219.1

(58) Field of Search ..... 428/124, 121; 150/158; 297/219.1; 5/513, 924, 620, 736

(56) References Cited

U.S. PATENT DOCUMENTS 4,751,115 A * 6/1988 Smith et al. ..... 428/12

* cited by examiner

*Primary Examiner*—Alexander S. Thomas
(74) *Attorney, Agent, or Firm*—Edward P. Dutkiewicz

(57) ABSTRACT

A furniture protection device in a generally rectangular configuration is comprised of a flat piece. The flat piece has a pair of long parallel side edges. The flat piece also has a pair of short parallel side edges. The flat piece further has a plurality of equally spaced creases. The equally spaced creases run parallel to the short side edges.

1 Claim, 3 Drawing Sheets

FIG 1
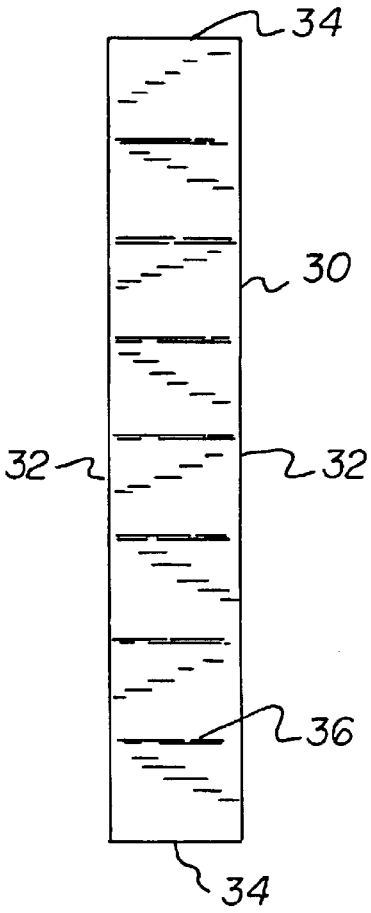
FIG 2
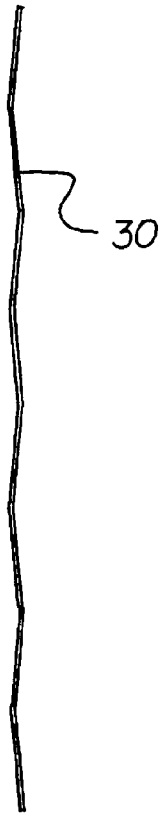
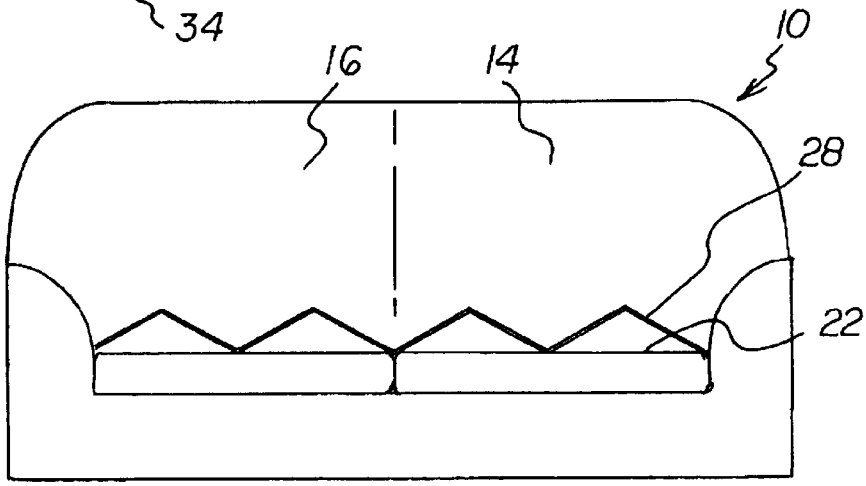
FIG 3

FIG 4
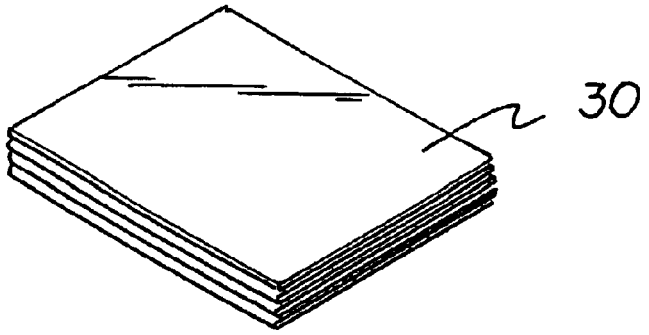
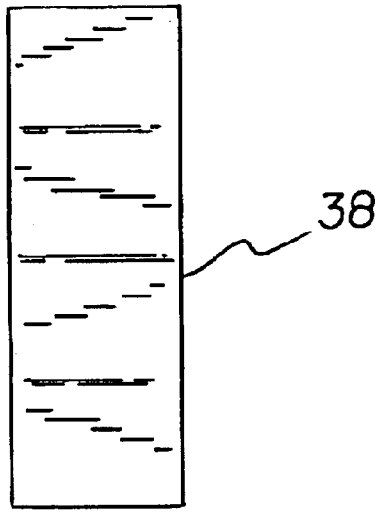
FIG 5
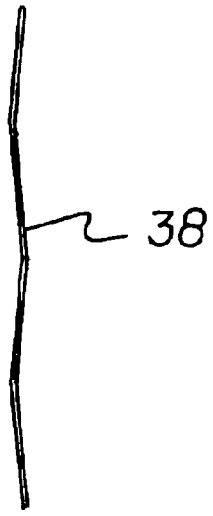
FIG 6

FIG 7
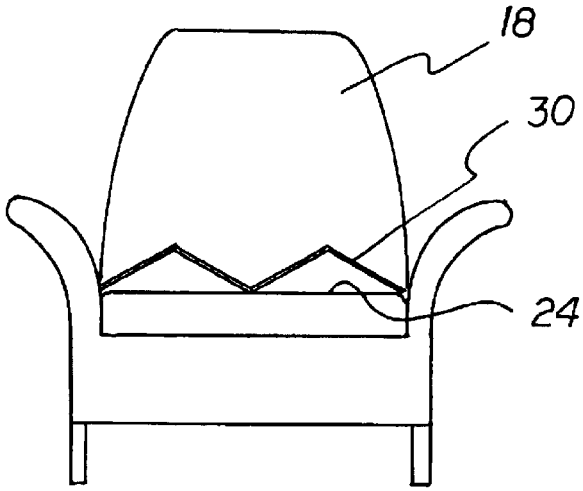
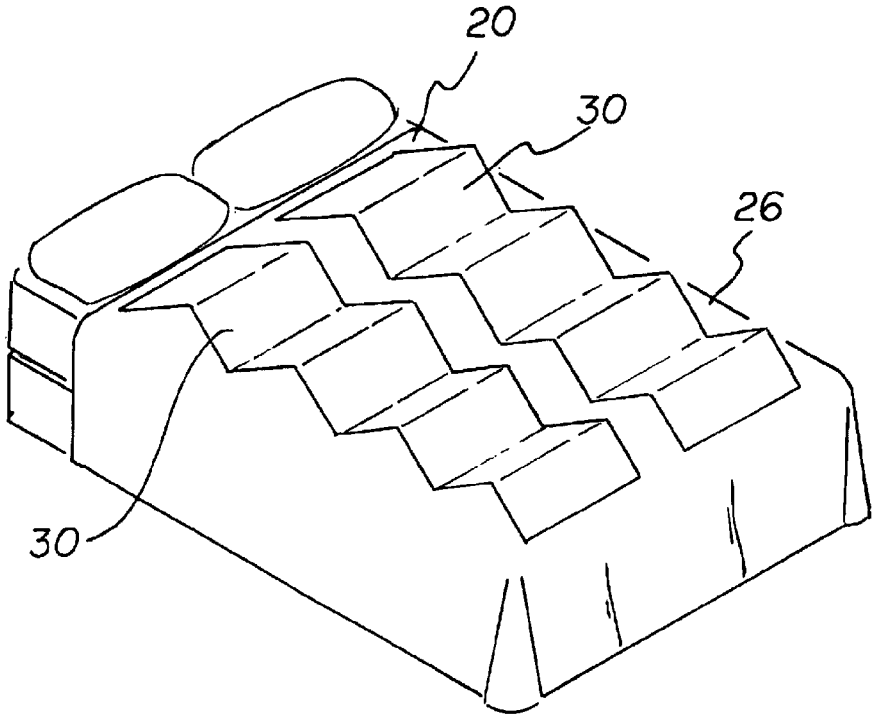
FIG 8

FURNITURE PROTECTION SYSTEM

BACKGROUND OF THE INVENTION

1. Field of the Invention

The present invention relates to a furniture protection system and more particularly pertains to precluding pets from walking, standing, sitting and reclining on furniture.

2. Description of the Prior Art

The use of protection systems for furniture of known design and configurations is known in the prior art. More specifically, protection systems for furniture of known design and configurations previously devised and utilized for the purpose of discouraging pets from getting on furniture through known methods and apparatus are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,702,791 to Zegeer discloses a furniture protector device. U.S. Pat. No. 5,537,952 to Devlin discloses a pet sheet bed cover. U.S. Pat. No. 4,943,105 to Kacar et al. discloses an automobile pet seat and cargo carrier. U.S. Pat. No. 2,936,102 to Field discloses an animal bed (construction). Finally, U.S. Pat. No. Des. 310,502 to Gantner discloses a shade for an automobile steering wheel and seat.

While these devices fulfill their respective, particular objectives and requirements, the aforementioned patents do not describe a furniture protection system that allows precluding pets from walking, standing, sitting and reclining on furniture.

In this respect, the furniture protection system according to the present invention substantially departs from the conventional concepts and designs of the prior art, and in doing so provides an apparatus primarily developed for the purpose of precluding pets from walking, standing, sitting and reclining on furniture.

Therefore, it can be appreciated that there exists a continuing need for a new and improved furniture protection system which can be used for precluding pets from walking, standing, sitting and reclining on furniture. In this regard, the present invention substantially fulfills this need.

SUMMARY OF THE INVENTION

In view of the foregoing disadvantages inherent in the known types of protection systems for furniture of known design and configurations now present in the prior art, the present invention provides an improved furniture protection system. As such, the general purpose of the present invention, which will be described subsequently in greater detail, is to provide a new and improved furniture protection system and method which has all the advantages of the prior art and none of the disadvantages.

To attain this, the present invention essentially comprises piece of furniture, such as a sofa, chair, bed, and the like. The piece of furniture has a relatively flat region that a user desires to protect from a pet animal. Provided next is a generally rectangular protection device. The device is comprised of a flat piece of cardboard. The piece of cardboard has a pair of long parallel side edges and a pair of short parallel side edges. The protection device is adapted to have various colors, textures and indicia. The protection device also has a plurality of creases running parallel to the short side edges. The creases are equally spaced along the length of the protection device. The creases are folds in alternating upward and downward fashion to form an accordion pattern. The accordion pattern enables the protection device to maintain a three dimensional configuration with raised lines and lowered lines despite a generally flat shape. The three dimensional configuration acts as a space filler positioned on and above the flat region of the piece of furniture. In this manner a pet animal is prevented from finding a space on the furniture to rest upon. The system is further adapted to be stored by folding the protection device along all its creases. In this manner the length of the protection device is reduced to the distance between the creases. In this manner the protection device is more conducive for storage. The protection device for use with a sofa is about 136 inches long and 20 inches wide and ⅛ inch thick with a ratio of about 7:1. The protection device for use with a chair is about 56 inches long and 20 inches wide and ⅛ inch thick with a ratio of about 3:1. The protection device for use with a bed with two protectors positioned side-by-side each protector is about 136 inches long and 20 inches wide and ⅛ inch thick with a ratio of about 7:1.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved furniture protection system which has all of the advantages of the prior art protection systems for furniture of known design and configurations and none of the disadvantages.

It is another object of the present invention to provide a new and improved furniture protection system which may be easily and efficiently manufactured and marketed.

It is further an object of the present invention to provide a new and improved furniture protection system which is of durable and reliable constructions.

An even further object of the present invention is to provide a new and improved furniture protection system which is susceptible of a low cost of manufacture with regard to both materials and labor, and which accordingly is then susceptible of low prices of sale to the consuming public, thereby making such furniture protection system economically available to the buying public.

Even still another object of the present invention is to provide a furniture protection system for precluding pets from walking, standing, sitting and reclining on furniture.

Lastly, it is an object of the present invention to provide a new and improved furniture protection device in a generally rectangular configuration is comprised of a flat piece. The flat piece has a pair of long parallel side edges. The flat piece also has a pair of short parallel side edges. The flat piece further has a plurality of equally spaced creases. The equally spaced creases run parallel to the short side edges.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a top plan view of a protection device for use with a sofa of the furniture protection system constructed in accordance with the principles of the present invention.

FIG. 2 is a side elevational view of the device shown in FIG. 1.

FIG. 3 is a front elevational view of the furniture protection system constructed in accordance with the principles of the present invention showing the protection device positioned on a sofa.

FIG. 4 is a perspective view of the protection device of the prior Figures shown in a folded configuration for transportation and storage.

FIG. 5 is a top plan view of a protection device similar to FIG. 1 but illustrating an alternate embodiment of the invention sized for a chair.

FIG. 6 is a side elevational view of the protection device shown in FIG. 5.

FIG. 7 is a front elevational view of the protection device of FIGS. 5 and 6 illustrated in an operative position on a chair.

FIG. 8 is a perspective view of an alternate embodiment of the invention shown in operative position on the bed.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved furniture protection system embodying the principles and concepts of the present invention and generally designated by the reference numeral 10 will be described.

The present invention, the furniture protection system 10 is comprised of a plurality of components. Such components are individually configured and correlated with respect to each other so as to attain the desired objective.

First provided is a piece of furniture 14, such as a sofa 16, chair 18, bed 20, and the like. The piece of furniture has a relatively flat region 22, 24, 26 that a user desires to protect from a pet animal.

Provided next is a generally rectangular protection device 30, 38. The device is comprised of a flat piece of cardboard. The piece of cardboard has a pair of long parallel side edges 32 and a pair of short parallel side edges 34. The protection device is adapted to have various colors, textures and indicia. The protection device also has a plurality of creases 36 running parallel to the short side edges. The creases are equally spaced along the length of the protection device. The creases are folds in alternating upward and downward fashion to form an accordion pattern. The accordion pattern enables the protection device to maintain a three dimensional configuration with raised lines and lowered lines despite a generally flat shape. The three dimensional configuration acts as a space filler positioned on and above the flat region of the piece of furniture. In this manner a pet animal is prevented from finding a space on the furniture to rest upon. The system is further adapted to be stored by folding the protection device along all its creases. In this manner the length of the protection device is reduced to the distance between the creases. In this manner the protection device is more conducive for storage. The protection device for use with a sofa 30 is about 136 inches long and 20 inches wide and ⅛ inch thick with a ratio of about 7:1. The protection device for use with a chair 38 is about 56 inches long and 20 inches wide and ⅛ inch thick with a ratio of about 3:1. The protection device for use with a bed 30 employs two protectors positioned side-by-side. Each protector is about 136 inches long and 20 inches wide and ⅛ inch thick with a ratio of about 7:1.

The furniture protection system of the present invention is preferably constructed of cardboard, folded accordion style. Colorful logo and artwork can be printed on the cardboard. The system can be sofa-size, chair-size, or bed-size. In the bed size two, or possibly three, protectors would be used. The furniture protection system can be adapted for use in other configurations using one or more protectors in a variety of sizes for sectional sofas, pit groups, loveseats, and other furniture. The system is simple to manufacture of inexpensive material making it reasonably priced for the consumer.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A furniture protection system for precluding pets from walking, standing, sitting and reclining on furniture comprising, in combination;

a piece of furniture, selected from the class of furniture including a sofa, a chair and a bed, each piece of furniture, having a relatively flat region that a user desires to protect from a pet animal; and a generally rectangular protection device being comprised of a flat piece of cardboard having a pair of long parallel side edges and a pair of short parallel side edges, the protection device being adapted to have various colors, textures and indicia, the protection device also having a plurality of creases running parallel to the short side edges with the creases being equally spaced along the length of the protection device, the creases being folds in alternating upward and downward fashion to form an accordion pattern, this accordion pattern enabling the protection device to maintain a three dimensional configuration with raised lines and lowered lines despite a generally flat shape, the lower lines being parallel lines positionable in contact with a flat region of the piece of furniture for support, this three dimensional configuration acts as a space filler positioned on and above the flat region of the piece of furniture thereby preventing a pet animal from finding a space on the furniture to rest upon, furthermore the system being adapted to be stored by folding the protection device along all its creases thereby reducing the length of the protection device to the distance between the creases making the protection device more conducive for storage, the protection device for use with a sofa being about 136 inches long and 20 inches wide and ⅛ inch thick, for use with a chair being about 56 inches long and 20 inches wide and ⅛ inch thick, and for use with a bed with two protectors positioned side-by-side each protector being about 136 inches long and 20 inches.

* * * * *